US005900624A

United States Patent [19]

Verghese et al.

[11] Patent Number: 5,900,624

[45] Date of Patent: May 4, 1999

[54] PHOTOCONDUCTIVE OPTICAL CORRELATOR

[75] Inventors: Simon Verghese, Boston; Elliott R. Brown, Billerica; Qing Hu, Boston, all of Mass.

[73] Assignee: Massachusetts Institute of Technology, Cambridge, Mass.

[21] Appl. No.: 08/654,642

[22] Filed: May 29, 1996

Related U.S. Application Data

[60] Provisional application No. 60/008,247, Dec. 6, 1995.

[51] Int. Cl.[6] ..... H01J 40/14

[52] U.S. Cl. ..... 250/214 LS; 250/214 VT

[58] Field of Search ..... 250/214 LS, 214 VT, 250/214 R, 207; 324/76.33, 76.35, 76.36; 313/52 H

[56] References Cited

U.S. PATENT DOCUMENTS

| | | | |
|---|---|---|---|
| 4,866,660 | 9/1989 | Merkelo et al. | 364/822 |
| 4,870,295 | 9/1989 | Rauscher | 250/214 LS |

OTHER PUBLICATIONS

F.W. Smith et al., "Picosecond GaAs–based photoconductive optoelectronic detectors", *Applied Physics Letters 54* (10): 890–892 (1989), Jan. 1989.

K. Grigoras et al., "Picosecond Lifetime Measurement in Semiconductor by Optoelectronic Autocorrelation", *Electronics Letters 27*(12): 1024–1025 (1991), Jun. 1991.

S. Verghese et al., "Correlation of Optical Pulses with A Low–Temperature–Grown GaAs Photoconductor" Proceedings of 1995 International Semiconductor Device Research Symposium, Charlottesville, Dec. 5–8, 1995, p. 433.

*Primary Examiner*—Que T. Le

*Attorney, Agent, or Firm*—Testa, Hurwitz & Thibeault, LLP

[57] ABSTRACT

An optical correlator for correlating incident optical signals is described. The correlator comprises a transmission line in close juxtaposition to a photoconductor. The photoconductor may be positioned within the transmission line. The transmission line and the photoconductor may be monolithically integrated on a substrate. The optical correlator has an electrical non-linear response to the incident optical signals that results from a voltage divider formed from the combination of the transmission line and the photoconductor. The electrical non-linear response is proportional to a second-order intensity autocorrelation function $g^{(2)}(\tau)$. The response time of the electrical nonlinear response is less than the width of the narrowest pulse of the optical signals and may be less than twenty picoseconds.

14 Claims, 4 Drawing Sheets

PHOTOCONDUCTIVE OPTICAL CORRELATOR

RELATED APPLICATIONS

The present invention claims priority to Provisional Application U.S. Ser. No. 60/008,247 filed Dec. 6, 1995, the entire disclosure of which is incorporated herein by reference.

GOVERNMENT SUPPORT

This invention was made with government support under Contract Number F 19628-95-C-0002 awarded by the Department of the Air Force and Grant Number 9400334-DMR awarded by the National Science Foundation. The government has certain rights in the invention.

FIELD OF THE INVENTION

The invention relates generally to the field of optical signal processing. In particular, the invention relates to apparatus and method of using ultrafast photoconductive optical correlators.

BACKGROUND OF THE INVENTION

Many applications such as pulsed-laser diagnostics, laser radar, and optical signal processing utilize information contained in modulations of the intensity envelope of optical pulses. Intensity modulations can be directly measured on time scales longer than approximately 10 ps with a high-speed photodetector and a sampling oscilloscope. However, for optical pulses shorter than a few picoseconds, the electrical signal generated by the high-speed photodetector is dispersed by the transmission line that couples the photodetector to the sampling receiver of the oscilloscope and the information is scrambled or lost completely.

Other techniques for measuring high-speed intensity modulation have been proposed. One technique utilizes two photoconductors separated by a length of transmission line to correlate the optical pulses. The temporal resolution of the correlation, however, is limited to several picoseconds because of linear dispersion of the electrical pulses in the transmission line.

Another technique for measuring high-speed intensity modulation utilizes a photodiode connected to a high-speed microwave detector with a short length of transmission line. The optical pulses are converted to electrical pulses by the photodiode. The electrical pulses then propagate along the transmission line and are cross-correlated by the microwave detector. The temporal resolution of this technique is also limited to several picoseconds because of linear dispersion along the transmission line and because of parasitic capacitance in the photodiode.

Streak cameras have been utilized in laboratory experiments to measure intensity modulations with temporal resolution of approximately one picosecond. Steak cameras, however, not practical for use in most system applications.

Sub-picosecond correlation techniques have been developed that utilize nonlinear crystals to measure intensity modulation. These correlation techniques measure the nth-order intensity autocorrelation function for orders of n=2,3. For example, autocorrelation techniques that utilize nonlinear crystals for second-harmonic generation measure the second-order intensity autocorrelation function:

$$g^{(2)}(\tau) = \frac{\langle I(t)I(t+\tau)\rangle_t}{\langle I(t)\rangle_t^2}.$$

These autocorrelation techniques, however, are notoriously sensitive to wavelength, polarization, intensity, and orientation of the input beams with respect to the crystal because of strict phase-matching requirements.

There currently exists a need for an all-solid-state ultrafast correlator that can be monolithically integrated and that is relatively insensitive to wavelength, polarization, intensity, and orientation of the input beams.

SUMMARY OF THE INVENTION

It is therefore a principal object of this invention to provide an ultrafast correlator that is monolithic and all-solid state and that is relatively insensitive to wavelength, polarization, intensity, and orientation of the input beams. It is another principal object of this invention to provide an ultrafast correlator with a temporal resolution limited by a lifetime of photo-excited carriers in a photoconductive material.

A principal discovery of the present invention is that the ultrafast nonlinear response of low-temperature-grown (LTG) gallium arsenide photoconductors can be exploited in a transmission line to measure the second-order intensity autocorrelation function of the incident optical pulses.

Accordingly, the present invention features an optical correlator for correlating incident optical signals where each of the signals has one or more optical pulses. The optical correlator may be a cross-correlator or an auto-correlator. The correlator comprises a transmission line in close juxtaposition to a photoconductor. The photoconductor may be positioned within the transmission line. The transmission line and the photoconductor may be monolithically integrated on a substrate.

The optical correlator has an electrical non-linear response to the incident optical signals and a response time. The electrical nonlinear response results from a voltage divider formed from the combination of the transmission line and the photoconductor. The electrical non-linear response may be proportional to a second-order intensity autocorrelation function $g^{(2)}(\tau)$. The response time of the electrical nonlinear response is less than the width of the narrowest pulse of the optical signals and may be less than twenty picoseconds.

The present invention also features an optical metrology apparatus including a source of optical radiation for providing reference optical signals where each of the signals has one or more optical pulses. The metrology apparatus also includes an optical correlator that is positioned to receive the reference optical signals from the source of optical radiation and is positioned to receive measurement optical signals received from an object.

The optical correlator utilized by the optical metrology apparatus includes a transmission line in close juxtaposition to a photoconductor. The optical correlator may includes a beamsplitter that divides each of the pulses of optical radiation into a first and a second pulse. The first optical pulse is reflected from an object prior to being combined with the second optical pulse in the optical correlator.

The optical correlator utilized by the optical metrology apparatus has an electrical non-linear response to the reference and the measurement optical signals and a response time. The electrical non-linear response results from a voltage divider formed from the combination of the transmission line and the photoconductor. The response time of the electrical nonlinear response is less than the width of the narrowest pulse of the reference and the measurement optical signals.

The present invention also features an absolute ranging apparatus including a source of optical radiation for providing reference optical signals where each of the signals has one or more optical pulses. The optical correlator is positioned to receive the reference optical signals from the source of optical radiation and is positioned to receive the measurement optical signals received from an object.

The optical correlator utilized by the absolute ranging apparatus includes a transmission line in close juxtaposition to a photoconductor. The optical correlator also includes an encoder for encoding selected pulses of the reference optical signals. The encoder may include a second photoconductor positioned to receive the pulses of radiation reflected from the object. The encoder may be a modulator.

The optical correlator utilized by the absolute ranging apparatus has an electrical non-linear response to the reference and the measurement optical signals and a response time. The electrical non-linear response results from a voltage divider formed from the combination of the transmission line and the photoconductor. The response time of the electrical nonlinear response is less than the width of the narrowest pulse of the reference and the measurement optical signals. The response time of the electrical nonlinear response is less than the width of the narrowest pulse of the reference and the measurement optical signals.

The present invention also features a recognition system including an optical metrology apparatus. The optical metrology apparatus comprises a source of optical radiation for providing reference optical signals where each of the signals has one or more optical pulses. The optical correlator is positioned to receive the reference optical signals from the source of optical radiation and is positioned to receive interrogation optical signals from an object.

The optical correlator utilized by the utilized by the recognition system includes a transmission line in close juxtaposition to a photoconductor. The optical correlator has an electrical non-linear response to the reference and the interrogation optical signals and a response time. The electrical non-linear response results from a voltage divider formed from the combination of the transmission line and the photoconductor. The response time of the electrical nonlinear response is less than the width of the narrowest pulse of the incident and the reflected optical signals. The response time of the electrical nonlinear response is less than the width of the narrowest pulse of the reference and the interrogation optical signals.

The recognition system also includes a computational system in electrical communication with the optical correlator. The computational system identifies an object in response to the correlation of the reference optical signals and the interrogation optical signals. The computational system may be a neural network.

BRIEF DESCRIPTION OF THE DRAWINGS

This invention is described with particularity in the appended claims. The above and further advantages of this invention may be better understood by referring to the following description taken in conjunction with the accompanying drawings, in which:

DETAILED DESCRIPTION

Figure 1:
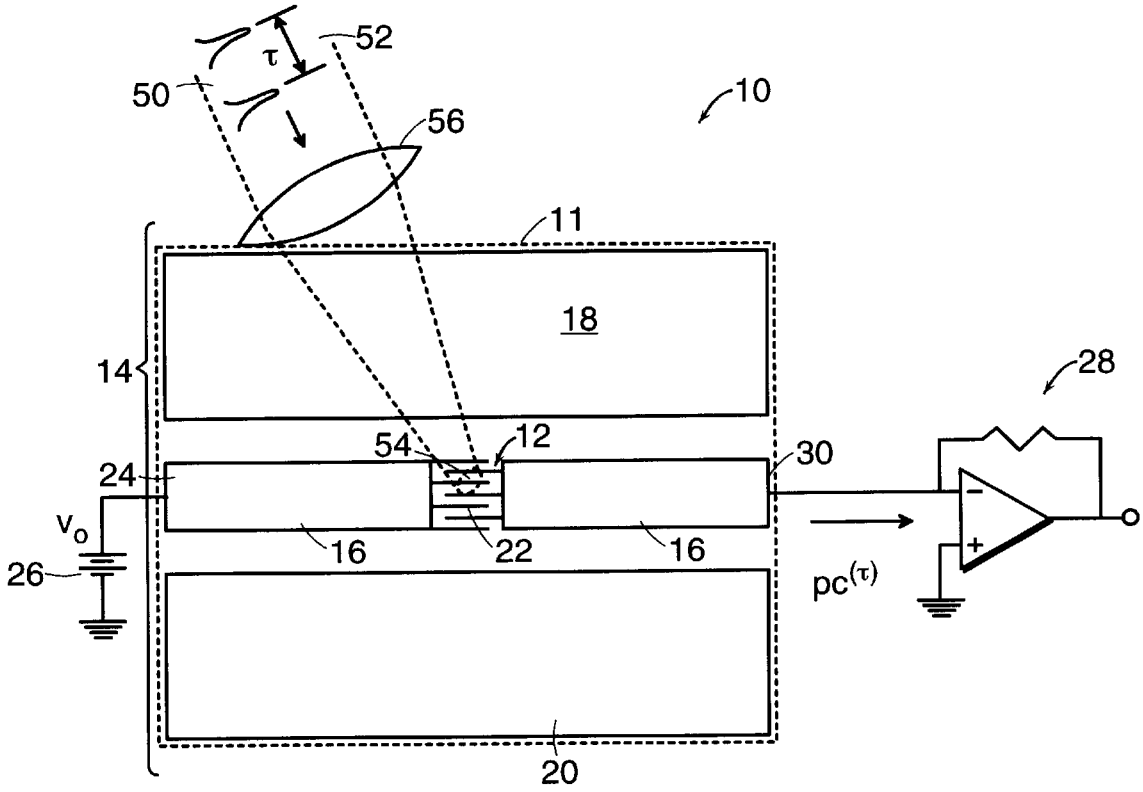
FIG. 1 is a schematic diagram of an embodiment of an ultrafast photoconductive optical correlator embodying the invention which includes a photoconductor embedded in a coplanar waveguide transmission line and a transimpedance amplifier for measuring the photocurrent generated by the photodetector.

FIG. 1 is a schematic diagram of an ultrafast photoconductive optical correlator (UPOC) 10 embodying the invention. The UPOC 10 includes a photodetector 11 comprising a photoconductor material 12 having a photoconductance G(t) embedded in a coplanar waveguide transmission line 14 having a characteristic impedance Zo. The coplanar waveguide transmission line 14 comprises an inner electrode 16 and a first 18 and a second outer conductor 20 that form a ground plane.

A series of interdigitated electrodes 22 is formed in the inner electrode 16 over a photoconductive material 12. Using interdigitated electrodes 22 maximizes the responsively of the photodetector 11. The interdigitated electrodes 22 are typically formed by utilizing a high-resolution lithography technique such as deep UV or electron beam lithography.

The inner electrode 16 is typically biased at one end 24 with a bias voltage supply 26. A transimpedance amplifier 28 is electrically coupled to another end 30 of the inner electrode 16. The transimpedance amplifier 28 measures the dc photocurrent generated by the photodetector 11. The temporal resolution of the UPOC 10 is limited by the lifetime of photo-excited carriers in the photconductive material 12. The photoconductive material 12 may be low-temperature grown gallium arsenide LTG-GaAs. Recent experiments have demonstrated that LTG-GaAs can have lifetimes of photoexcited carriers which approaches 70 fs. A UPOC 10 utilizing LTG-GaAs could have a temporal resolution less than 0.1 ps.

In operation, incident optical pulses 50 having intensity I(t) and separated by a time delay $\tau$52 are focused onto a spot 54 in the photconductive material 12 that is covered by the interdigitated electrodes 22. A lens 56 may be used to focus the incident optical pulses 50 onto the spot 54. A photocurrent $i_{pc}(t)$ which is generated by the photodetector 11 in response to the intensity I(t) of the incident optical pulses 50 responds nonlinearly to the intensity I(t).

The photocurrent $i_{pc}(t)$ can be approximated by $$i_{pc}(t) = \frac{V_o}{Z_o + G(t)^{-1}} \tag{1}$$

where $V_0$ is the bias voltage generated by the bias voltage supply 26, Zo is the characteristic impedance of the coplanar waveguide transmission line 14, and G(t) is the photoconductance which is proportional to the intensity I(t) of the incident optical pulses 50. For a square geometry, the photoconductance G(t) may be expressed as $$G(t) = \alpha I(t), \text{ where} \quad (2)$$
$$\alpha = \frac{\eta}{\hbar\omega}\tau_{e-h}e(\mu_e + \mu_h), \text{ and}$$

where $\eta$ is the external quantum efficiency, $\tau_{e-h}$ is the effective carrier lifetime, and $\mu_e$ and $\mu_h$ the electron and hole mobilities, respectively.

For small intensities I(t), the photocurrent $i_{pc}(t)$ is linear since the inverse of the photoconductance $G(t)^{-1}$ will be much greater than the characteristic impedance $Z_o$. For larger intensities I(t), however, the photoconductor responds nonlinearly in I(t). This nonlinearity is exploited by the UPOC 10 to measure $g^{(2)}(\tau)$, the second-order intensity autocorrelation function in the following way.

The photocurrent $i_{pc}(t)$ can be approximated phenomenologically in terms of the lowest order nonlinearity by $$i_{pc}(t) \approx S_I^{(2)}(I(t))^2, \quad (3)$$

where $S_1^{(2)}$ is the second-order nonlinear current responsivity of the photoconductive material 12.

For two cross-polarized incident optical beams, which are separated by a variable time-delay r, the incident intensity at the photoconductor can be represented by $I_T(t)=I(t)+I(t+r)$. Thus the time average of the photocurrent $i_{pc}(t)$ can be expressed as a function of the variable time-delay r:

$$\langle i_{pc}(\tau)\rangle_t = 2S_I^{(2)}\langle I(t)I(t+\tau)\rangle_t + \text{const.} \quad (4)$$

Neglecting the constant terms, the time averaged photocurrent is proportional to the second-order intensity autocorrelation function $$g^{(2)}(\tau) = \frac{\langle I(t)I(t+\tau)\rangle_t}{\langle I(t)\rangle_t^2} \quad (5)$$

in the limit that the photoconductor's nonlinear responsivity $S_I^{(2)}$ depends weakly on I(t). Therefore, the intensity autocorrelation function can be detected by measuring the dc photocurrent of the UPOC 10 as a function of the time delay.

The temporal resolution of the UPOC 10 is determined by the time required for the photoconductive material 12 to return to a high resistance state after brief illumination by the optical pulses 50. This time may be less than 100 fs for materials with ultrafast nonlinear responses such as low-temperature-grown gallium arsenide.

Figure 2:
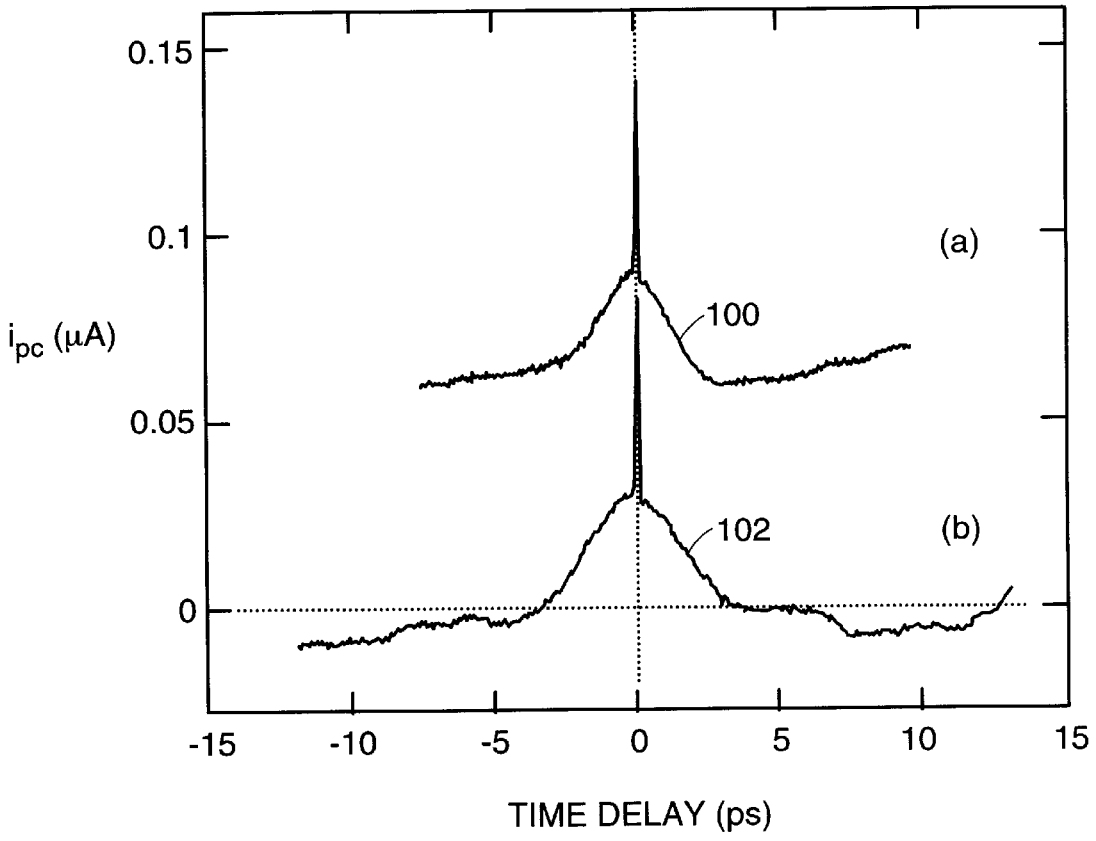
FIG. 2 illustrates the operation of a low-temperature-grown gallium arsenide ultrafast photoconductive optical correlator. Curve A illustrates measured values of photocurrent $i_{pc}(t)$ as a function of time-delay for two optical pulses which have been dispersed by propagating through 43 cm of single-mode optical fiber. Curve B illustrates measured values of photocurrent $i_{pc}(t)$ as a function of time delay for two optical pulses which have been dispersed by propagating through 94 cm of fiber.

FIG. 2 illustrates the operation of a low-temperature-grown gallium arsenide ultrafast photoconductive optical correlator (UPOC). The UPOC was fabricated with a low-temperature-grown gallium arsenide photoconductor that was approximately 10×3 microns. The photoconductor was integrated into a high-frequency coplanar waveguide patterned from a Au:Ti metal film. Two pulse trains of ~80 fs pulses @810 nm were coupled to the LTG-GaAs photoconductor through a length of single-mode optical fiber. The optical fiber dispersed the ~80 fs pulses to picosecond time scales.

FIG. 2*a* illustrates measured values of photocurrent $i_{pc}(t)$ as a function of time-delay for two ~80 fs optical pulse trains at 810 nm which have been dispersed by propagating through 43 cm of single-mode optical fiber. The full width half maximum (FWHM) of the rounded shoulders is approximately 2 ps. Deconvolution, assuming a $\text{sech}^2(t)$ pulse-shape, indicates a temporal width of 1.3 ps for the dispersed optical pulse.

The shape of the resulting photocurrent curve 100 is similar to autocorrelation curves measured for dispersed pulses with a conventional autocorrelator. The sharp peak in the center of the curve 100 is a coherence peak whose width is approximately the inverse of the pulse's optical bandwidth. The coherence peak contains no information about the time-scale of the modulated intensity and can be eliminated by coupling the two pulse trains with crossed polarizations through a polarization-maintaining optical fiber. The rounded shoulders on either side of the coherence peak contain information about the temporal width of the dispersion-broadened pulse.

FIG. 2*b* illustrates measured values of photocurrent $i_{pc}(t)$ as a function of time-delay for two ~80 fs optical pulse trains at 810 nm which have been dispersed by propagating through 94 cm of single-mode optical fiber. The shape of the resulting curve 102 is similar to FIG. 2*a*. Deconvolution indicates a width of the dispersed pulse equal to of 1.9 ps.

The UPOC thus can measure the increased dispersion produced by the longer fiber on a picosecond time-scale. Note that the coherence peak has the same width in both traces. This suggests that the bandwidth has been preserved and that the correlator is measuring the additional dispersion of the intensity envelope caused by the longer optical fiber.

The UPOC 10 (FIG. 1) can be a direct replacement for the prior art sub-picosecond autocorrelators. The UPOC 10 is advantageous because it does not require a photomultiplier tube, gimble mounted nonlinear crystal, or a UV filter. The UPOC 10 is structurally simpler, more compact, less expensive to manufacture and simpler to operate than prior art sub-picosecond autocorrelators. The UPOC 10 has a temporal resolution limited by the lifetime of photo-excited carriers in a photoconductive material.

The UPOC 10 is useful for numerous applications such as high-speed laser diagnostics, laser radar, optical signal processing, and target recognition. The UPOC 10 can be utilized in a sampling circuit as a cross-correlator to resolve streams of optical signals which use fast modulations of intensity to encode information. Also, the UPOC 10 is useful for time-frequency analysis, such as calculating Wigner distributions, for target classification and for monitoring manufacturing processes where remote depth-profiling is important.

Figure 3:
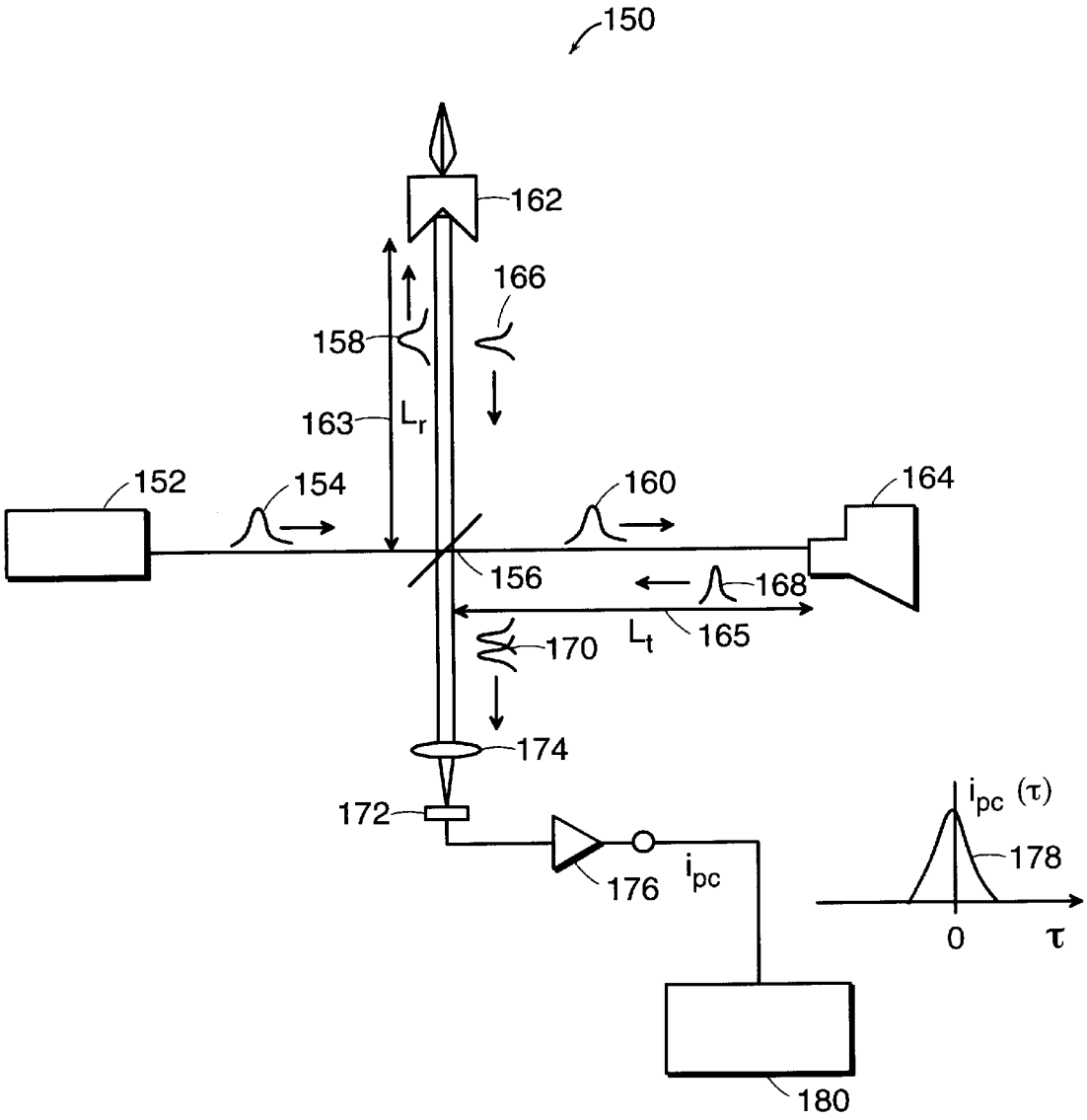
FIG. 3 illustrates an embodiment of an optical metrology apparatus utilizing the embodiment of the ultrafast photoconductive optical correlator shown in FIG. 1.

FIG. 3 illustrates an optical metrology apparatus 150 utilizing an ultrafast photoconductive optical correlator (UPOC) which embodies the invention. The metrology apparatus 150 includes a source of optical radiation 152 for providing incident optical signals 154 where each of the signals has one or more optical pulses. The source of radiation 152 may be a mode locked laser. A beamsplitter 156 splits the incident optical signals 154 into reference optical signals 158 and measurement optical signals 160.

A reference reflector 162 is positioned at a distance Lr 163 from the beamsplitter 156. The reference reflector 162 may be continually scanned over a distance that is more than half the distance between adjacent pulses of the reference optical signals 158. The reference reflector 162 retroreflects the reference optical signals. Returning reference optical signals 166 are directed back to the beamsplitter 156. A target 164 is positioned at a distance Lt 165 from the beamsplitter 156. The target 164 reflects the measurement optical signals 160. Returning measurement optical signals 168 are directed back to the beamsplitter 156.

The returning reference optical signals 166 are combined at the beamsplitter 156 with the returning measurement optical signals 168 to form resulting optical signals 170. The resulting optical signals 170 are coupled to an ultrafast photoconductive optical correlator (UPOC) 172. A lens 174 may be utilized to collimate the resulting optical signals 170 before they are coupled to the UPOC 172. A transimpedance amplifier 176 measures the dc photocurrent generated by the UPOC 172.

The UPOC 172 utilized by the optical metrology apparatus 150 includes a transmission line in close juxtaposition to a photoconductor as described above in connection with FIG. 1. The UPOC 172 has an electrical non-linear response to the resulting optical signals 170 and a response time. The electrical non-linear response results from a voltage divider formed from the combination of the transmission line and the photoconductor. The response time of the electrical nonlinear response is less than the width of the narrowest pulse of the reference and measurement optical signals.

In operation, when the distance Lr 163 is equal to the distance Lt 165, there is a zero path difference between the reference 162 and the target 164. The Nth pulse from the source of optical radiation 152 is combined with the Nth pulse returning from the target 164 at the beamsplitter 156. A nonzero cross-correlation signal 178 is generated by UPOC 172. A threshold detector (not shown) may detect the correlation and trigger a computer (not shown) to store the value of Lr 163 which is equal to Lt 165, the distance from the beamsplitter 156 to the target 164. The resolution of this optical metrology apparatus utilizing the UPOC 172 may be less than 15 $\mu$m.

The optical metrology apparatus 150 can be utilized for measuring three-dimensional range profiles. Such profiles are useful for recognition systems such as automatic facial recognition systems commonly utilized in surveillance and security systems. Three-dimensional range profiles can be obtained by correlating the Nth pulse returning from the target 164 with the Mth pulse from the source of optical radiation 152. The integer M-N is the number of pulses emitted by the source of radiation 152 after the Nth pulse was emitted and before the Nth pulse returns from the target 164.

A nonzero cross-correlation signal 178 is generated by the UPOC 172 indicating variations in range across the target 164. These variations in range across the target can be compared with stored data for determining if a range profile matches a stored range profile. Note that the value of M-N is not required as long as the variation in range does not exceed the pulse-to-pulse distance.

The optical metrology apparatus 150 may also include a computational system 180 in electrical communication with the UPOC 172. The computational system 180 identifies an object in response to the cross-correlation signal 178. The computational system 180 may be a neural network.

Figure 4:
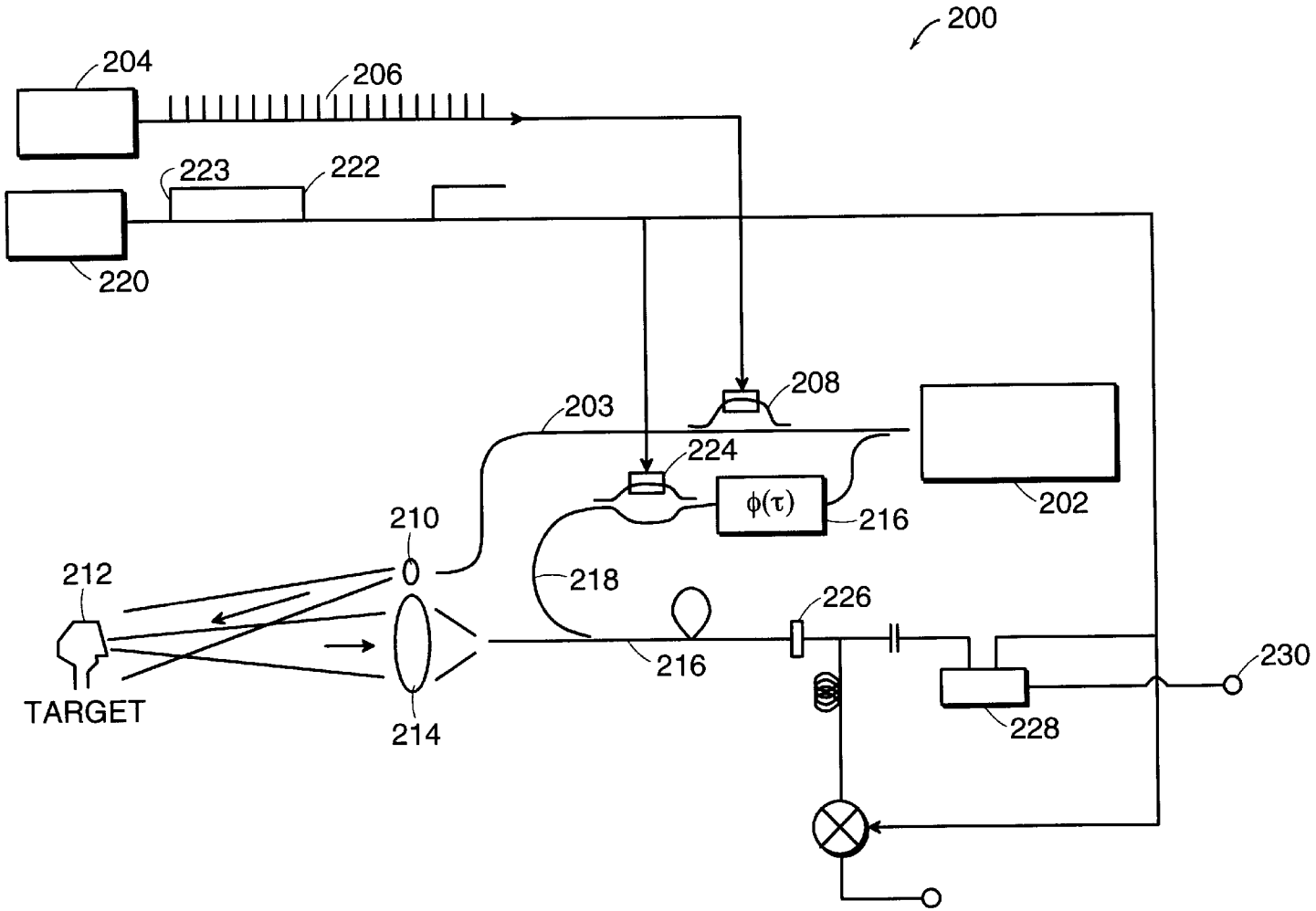
FIG. 4 illustrates an embodiment of an absolute ranging apparatus utilizing the ultrafast photoconductive optical correlator shown in FIG. 1.

FIG. 4 illustrates an absolute ranging apparatus 200 utilizing an ultrafast photoconductive optical correlator which embodies the invention. The functionality of the recognition system is similar to the optical metrology apparatus 150 described in connection with FIG. 3. However, the beam combining and routing is implemented in optical fiber.

The absolute ranging apparatus 200 comprises a source of optical radiation 202 for providing incident optical signals where each of the signals has one or more optical pulses. The source of optical radiation 202 is coupled to a target arm optical fiber 203. The absolute ranging apparatus 200 also includes an encoder 204 for generating encoding signals 206. The encoder 204 may be a modulator.

A Mach-Zender variable attenuator 208 combines the encoding signals 206 with the incident optical signals to generate encoded target optical signals. The target optical signals are guided by the target fiber 203 to a lens 210. The lens 210 focuses the target optical signals onto a target 212. The target 212 reflects the target optical signals. A second lens 214 focuses the target optical signals into the optical fiber 216.

The source of optical radiation 202 is also coupled to a reference fiber 218. A scanned delay line 216 scans at a frequency over half the distance between adjacent incident optical signal pulses. A clock 220 generates a modulation signal 222 which is combined with scanned incident optical signal pulses by a second Mach-Zender variable attenuator 224 to form reference optical signal pulses labeled by the modulation signal 222. The clock 220 may be derived from the encoder 204. The reference optical signals are coupled to the optical fiber 216.

An ultrafast photoconductive optical correlator (UPOC) 226 is coupled to the optical fiber 216. The UPOC receives the reference optical signals and the target optical signals. The UPOC 226 includes a transmission line in close juxtaposition to a photoconductor as described above in connection with FIG. 1. The optical correlator has an electrical non-linear response to the reference and the target optical signals and a response time. The electrical non-linear response results from a voltage divider formed from the combination of the transmission line and the photoconductor. The response time of the electrical nonlinear response is less than the width of the narrowest pulse of the reference and the target optical signals.

The UPOC cross-correlates the reference optical signals with the target optical signals. The maximum cross-correlation signal occurs when the source-to-target distance is an integral number of reference fiber lengths. A counter 228 determines the integer number of reference fiber lengths by detecting the cross-correlation signal. Typically, a rising edge 223 of the modulation signal 222 starts the counter 228. The counter 228 then counts the number of pulses until a labeled pulse arrives and stops the counter 228. An output 230 of the counter 228 is utilized to determine M-N. The counter 228 may be a timing circuit similar to ones used in prior art laser radar systems. The temporal resolution of such a counter must be sufficiently short to resolve the time between adjacent pulses.

EQUIVALENTS

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. An optical correlator correlating between incident optical signals, comprising one or more optical pulses each having a pulse width, said optical correlator comprising:

a transmission line in close juxtaposition to a photoconductor, said optical correlator having an electrical non-linear response to said incident optical signals and having a response time, said electrical nonlinear response resulting from a voltage divider comprising the combination of said transmission line and said photoconductor, said response time of said electrical nonlinear response being less than the width of the narrowest pulse of said optical signals.

2. The optical correlator of claim 1 wherein said electrical non-linear response is less than twenty picoseconds.

3. The optical correlator of claim 1 wherein said electrical non-linear response is proportional to a second-order intensity autocorrelation function $g^{(2)}(\tau)$.

4. The optical correlator of claim 1 wherein said correlator is a cross-correlator.

5. The optical correlator of claim 1 wherein said correlator is an auto-correlator.

6. The optical correlator of claim 1 wherein said photoconductor is positioned within said transmission line.

7. The optical correlator of claim 1 wherein said transmission line and said photoconductor are monolithically integrated on a substrate.

8. An optical metrology apparatus comprising:

a) a source of optical radiation providing reference optical signals, comprising one or more optical pulses each having a pulse width; and b) an optical correlator positioned to receive said reference optical signals from said source of optical radiation and measurement optical signals received from an object, said optical correlator comprising a transmission line in close juxtaposition to a photoconductor, said optical correlator having an electrical non-linear response to said reference and said measurement optical signals and having a response time, said electrical non-linear response resulting from a voltage divider comprising the combination of said transmission line and said photoconductor, said response time of said electrical nonlinear response being less than the width of the narrowest pulse of said reference and said measurement optical signals.

9. The optical correlator of claim 8 wherein said optical correlator further includes a beamsplitter, said beamsplitter dividing each of said pulses of optical radiation into a first and a second pulse, said first optical pulse being reflected from an object prior to being combined with said second optical pulse in said optical correlator.

10. An absolute ranging apparatus comprising:

a) a source of optical radiation providing reference optical signals, comprising one or more optical pulses each having a pulse width;

b) an optical correlator positioned to receive said reference optical signals from said source of optical radiation and measurement optical signals received from an object, said optical correlator comprising a transmission line in close juxtaposition to a photoconductor, and c) an encoder for encoding selected pulses of said reference optical signals, d) said optical correlator having an electrical non-linear response to said reference and said measurement optical signals and having a response time, said electrical non-linear response resulting from a voltage divider comprising the combination of said transmission line and said photoconductor, e) said response time of said electrical nonlinear response being less than the width of the narrowest pulse of said reference and said measurement optical signals.

11. The absolute ranging apparatus of claim 10, wherein said encoder comprises a modulator.

12. The absolute ranging apparatus of claim 10, wherein said encoder comprises a second photoconductor positioned to receive said pulses of radiation reflected from said object.

13. A recognition system comprising:

a) an optical metrology apparatus comprising:

i) a source of optical radiation providing reference optical signals, comprising one or more optical pulses each having a pulse width; and ii) an optical correlator positioned to receive said reference optical signals from said source of optical radiation and interrogation optical signals received from an object, said optical correlator comprising a transmission line in close juxtaposition to a photoconductor, iii) said optical correlator having an electrical non-linear response to said reference and said interrogation optical signals and having a response time, said electrical non-linear response resulting from a voltage divider comprising the combination of said transmission line and said photoconductor, said response time of said electrical nonlinear response being less than the width of the narrowest pulse of said incident and reflected optical signals; and b) a computational system in electrical communication with said optical correlator, said computational system identifying an object in response to the correlation of said reference optical signals and said interrogation optical signals.

14. The apparatus of claim 11 wherein said computational system is a neural network.

* * * * *

UNITED STATES PATENT AND TRADEMARK OFFICE

CERTIFICATE OF CORRECTION

PATENT NO. : 5,900,624
DATED : May 4, 1999
INVENTOR(S) : Simon Verghese, Elliott R. Brown; Qing Hu It is certified that error appears in the above-identified patent and that said Letters Patent is hereby corrected as shown below:

Claim 14, first line, delete "apparatus of claim 11" and insert ---system of claim 13---.

Signed and Sealed this

Seventeenth Day of October, 2000

*Attest:*

Q. TODD DICKINSON

*Attesting Officer*

*Director of Patents and Trademarks*